United States Patent [19]

Shelby et al.

[11] 4,424,993

[45] Jan. 10, 1984

[54] LATCH MECHANISM FOR LUMINAIRE

[75] Inventors: Billy L. Shelby; William C. Moore, both of Memphis, Tenn.

[73] Assignee: International Telephone and Telegraph Corporation, New York, N.Y.

[21] Appl. No.: 268,389

[22] Filed: May 29, 1981

[51] Int. Cl.[3] ..... E05C 3/14

[52] U.S. Cl. ..... 292/128

[58] Field of Search ..... 292/128, 228, DIG. 53, 292/DIG. 38, 121, 219; 240/147

[56] References Cited

U.S. PATENT DOCUMENTS

| | | | |
|---|---|---|---|
| 613,812 | 11/1898 | Alberswerth | 292/128 |
| 1,198,828 | 9/1916 | Dixon | 292/128 X |
| 1,532,023 | 3/1925 | Barrows | 292/228 X |
| 1,621,630 | 3/1927 | Debus | 292/128 |
| 2,663,447 | 12/1953 | Westcott | 292/128 X |

*Primary Examiner*—Richard E. Moore

*Attorney, Agent, or Firm*—James B. Raden; Marvin M. Chaban

[57] ABSTRACT

A latch mechanism for use in a street and roadway lighting luminaire. The latch mechanism operates generally in the same fashion as prior latch mechanisms to release the engagement between the upper and lower housings responsive to manual actuation of a pawl of the latch mechanism against the bias of a torsion spring. The present mechanism may be readily detached and replaced without the need for elaborate spring depressors. Two torsion springs are employed, one fitted to each side of the latch pawl to hold and bias the pawl. The springs can be released individually to enable removal of the pawl. On replacement, the pawl is slipped into the cast-in nesting arrangement with the two springs loosely fitted on the pawl. The springs are then depressed to their pawl-biasing condition to mount and affix the pawl to the lower housing. In this manner, the pawl can be replaced, if desired, without the need for tools of any kind, especially since the mounting of the latch in its housing is performed without screws or bolts.

4 Claims, 9 Drawing Figures

LATCH MECHANISM FOR LUMINAIRE

BACKGROUND OF THE INVENTION

Roadway or street lighting luminaires are, of course, well-known. One type, the horizontal burning type is, of course, equally well-known. In this type of luminaire, one end of the luminaire is mounted on a horizontal mast, the other end being cantilevered from the mast mounting. The luminaire is essentially comprised of two joined housings, an upper housing and a lower housing. The mounting of the luminaire to the mast is generally performed in the upper housing. The lower housing is generally hinged to the upper housing at the mounting end thereof. The remote or other end of the lower housing is latched to the upper housing by a manually operable latch. Such latches with but minor variation have been generally used since at least the early 1960's.

In the known prior art latch mechanisms, a latch pawl having an elongate body is secured to the lower housing. One end of the pawl engages a sized opening in the upper housing to latch and hold the housing together. A torsion spring affixed to side mounting pivot rods of the pawl acts to bias the pawl to its latched condition. A free end of the pawl extends through an opening in the lower housing and is accessible from the exterior of the luminaire. By manually pivoting the pawl against the bias of the torsion spring, the latching of the pawl to the latch opening in the upper housing is released and the lower housing is free to pivot about its hinged end to an open position allowing access to the upper housing cavity.

In the known and generally used latch mechanism, the pivot rod of the pawl is secured to the housing by suitable mounting screws. To assemble the mechanism, the unitary torsion spring is fitted on both ends of the pivot rod, the spring is squeezed or depressed and the latch pawl must be held in place while the mounting screws are assembled and tightened. For most applications, a mounting fixture is used to depress or squeeze the spring and hold the pawl in place until the screws can be tightened. With the luminaire mounted in an elevated position on a pole, the difficulty of using such fixtures and screw fastenings is readily apparent.

Further, it is well known that self-threading screws have a tendency toward premature embrittlement and resulting breakage. Breakage of a screw frequently requires replacement of the entire luminaire, since self-threading screws can rarely be removed, especially when the breakage is flush with the exposed surface of the screw receiver.

In many of the known devices, the latch strike opening was formed by mounting a latch strike member in the upper housing. The strike member is generally mounted at its lateral ends by screws into suitable bosses in the upper housing.

SUMMARY OF THE INVENTION

The present invention is directed to an improved latch mechanism for a luminaire, which latch can be replaced easily even with the luminaire mounted on a pole.

The invention provides a latch pawl which is held within a cast-in semi-circular bearing structure in one of a pair of housings to be held together. A torsion spring biases the pawl into a holding position and acts to hold the pawl within the bearing structure. Manual depression of the pawl against the spring bias releases the hold between the housings. The spring is formed of two sections which may be mounted individually on the horizontally extending mounting or pivot pins of the pawl. The pawl may readily be inserted into the bearing structure with the sections of the spring loosely held on the mounting arms of the pawl. With the pawl in place in the bearing structure, the two spring sections may be individually snapped into their biasing position on the pawl. The pawl has a latching finger which mates with a cast-in pawl receiver in the second of the housings to latch the two housings together. By contrast to the previously described method, the ease of assembly of the present mechanism is clear. Replacement of the pawl can be undertaken with the luminaire mounted on its pole in a simple, uncomplicated manner.

Further, the pawl mechanism is supported and held in place without the need for any mounting screws by the bearing structure and springs holding the pivot pins supporting the pawl for rotation about the axis of the pivot pins.

DETAILED DESCRIPTION

Figure 1:
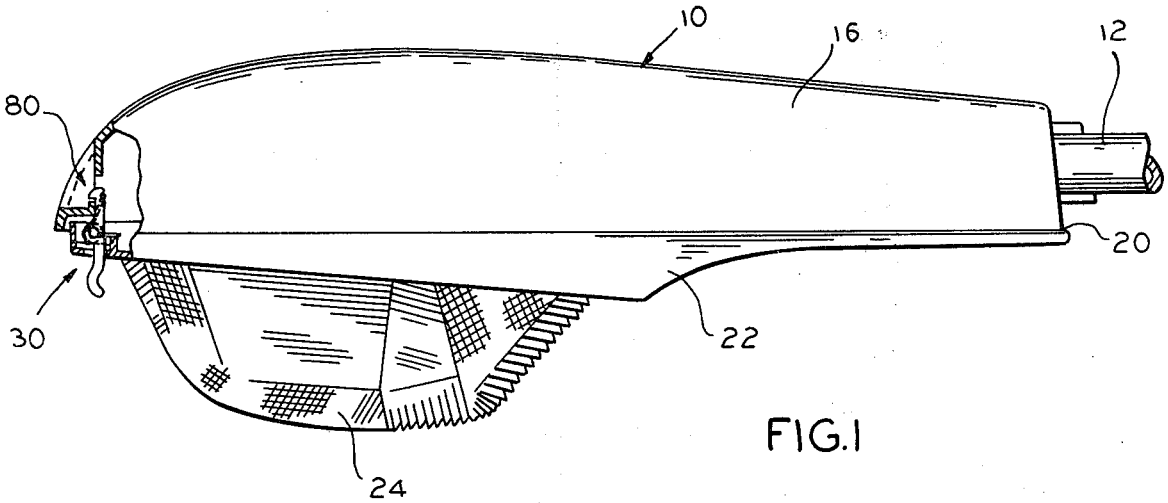
FIG. 1 is a side view in elevation of a luminaire employing our invention, the luminaire partially broken away to show an interior portion thereof.

In FIG. 1, I show a horizontal burning luminaire 10 employing my invention. The luminaire 10 is of a type conventional in outdoor lighting for illuminating roadways, streets and other outdoor areas.

The luminaire conventionally mounts on a horizontal mast 12 by any suitable mounting clamps (not shown). The luminaire 10 is comprised of an upper housing 16 which is secured to the mast by the mounting. In this way, the upper housing is stationarily fixed on the mast in the position of FIG. 1. Hinged at the mounting end of the upper housing by a suitable hinge 20 is the lower housing 22. The lower housing generally contains framing structure encircling and bearing a refractor 24. The lower housing is latched to the upper housing at the remote end, the latching being releasable to enable the lower housing to be pivoted about the hinge 20 and lowered to expose the interior of the luminaire for servicing and/or replacement of parts. Reclosure of the latch mechanism closes the lower housing to the upper housing in a weather tight closure.

The latch mechanism 30, as shown herein is used in place of the conventional latch mechanism. The latch mecnanism 30 has as its main component, a unitary latch pawl 32 which is pivotally secured to the lower housing and is positioned to engage a ledge 34 in the upper housing to latch the housings together with the lower housing in the closed or latched condition.

The unitary latch pawl as shown best in FIGS. 2, 3, 6 and 7 has an elongated body 40 terminating at an arcuate trigger 42 in its lower portion. The trigger is adapted to be engaged and pivotally moved in its release direction by the finger of a maintenance person. At its intermediate portion, the latch pawl has aligned laterally extending pivot pins 44 integral with the pawl, the pins forming a pivotal shaft for the pawl. Adjacent its upper end, the pawl has a finger or hook member 46 extending forwardly of the pawl body (FIG. 2) with a recess 48 in the rear wall of the pawl adjacent the hook member, the functioning of which will be explained.

As the latch mechanism is assembled to the lower housing, two torsion springs 50 and 51 are mounted on the pawl, one torsion spring on each pivot pin 44. Each torsion spring has a central helical area, each such helix 52 being sized to fit loosely on a pivot rod. Each spring 50 and 51 has a tang 54 extending tangentially from one end of the helix and a projection 56 rectangularly stepped from the opposite end of the helix a distance spaced from the helical area. Two such shaped springs are provided, one being the mirror image of the other; each mounted on one of the pivot pins of the pawl with its projection 56 extending in the direction of the pawl body. The stepped projection 56 of each spring is adapted to fit within the rear wall recess 48 of the pawl. The tang 54 of each spring is adapted to mate with a fixed member of the lower housing and bias the pawl relative to the lower housing toward its latched condition.

Figure 2:
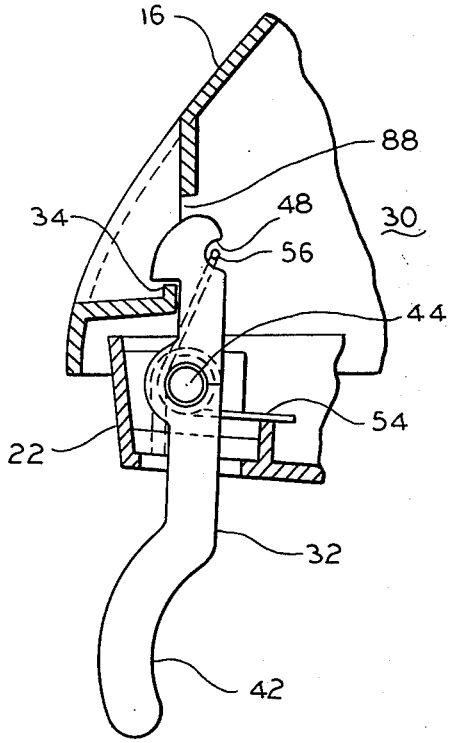
FIG. 2 is an enlarged section of the interior portion of FIG. 1, with the housings latched together in a closed position.
Figure 3:
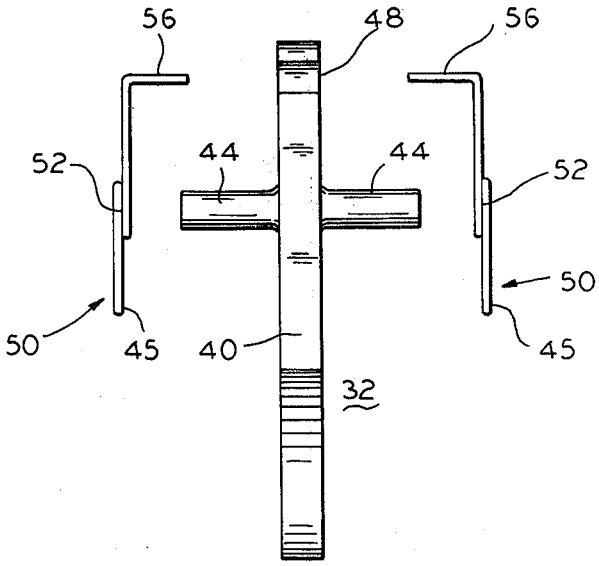
FIG. 3 is an exploded elevational view of the latch pawl and springs of FIGS. 1 and 2.
Figure 8:
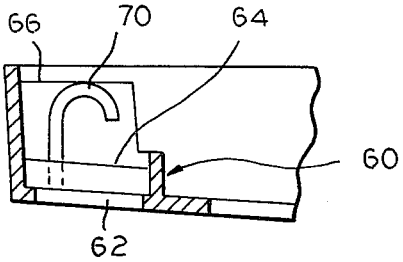
FIG. 8 is a sectional view of the nesting or pawl mounting arrangement in the lower housing, FIG. 8 representing a section taken along line 8—8 of FIG. 9.
Figure 9:
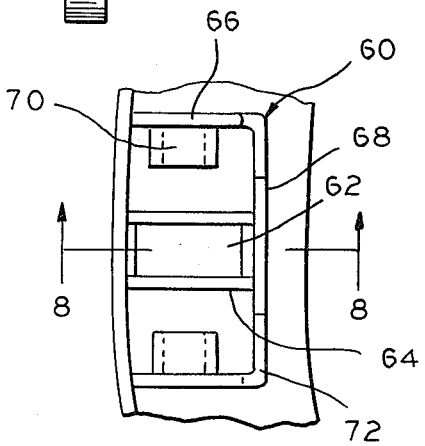
FIG. 9 is a plan view of the latch end of the lower housing.

The lower housing has a cast-in structure 60 for receiving the latch pawl. The cast-in structure or nest 60 shown best in FIGS. 8 and 9 includes a central through-opening 62 for the body of the pawl. The pawl extends through opening 62 to expose the arcuate trigger externally of the luminaire (FIG. 2). Flanking the central opening 62 are raised ribs 64 framing the opening. The structure 60 further includes enclosing transverse side walls 66 spaced outwardly of ribs 64 joining a rear wall framing the opening. Each of the sidewalls 66 has an inverted J hook member 70 on its inner surface, the hook for each side being open at the rear. The rear wall 68 is raised providing a ridge 72 laterally outwardly of the through opening area.

The hook members 70 provide pivotal nesting or semi-circular bearings for the pivot pins 44 of latch pawl 32 to hold the pawl against vertical movement relative to the lower housing. With the torsion springs fitted on the pivot pins, the tangs 54 rest on the rear wall ridges 68. The stepped projections of the springs both may be advanced to rest within the recess 48 of the pawl as in FIG. 7 and the pawl is thereby biased forwardly in the position seen in FIG. 6. The springs act to bias the pawl relative to the lower housing toward its closed position, and further acts to hold the pawl in position within the respective hook members 70. In this way, the pawl is held within the cast-in structural nest by the two springs 50 and 51 and the pawl is biased by these springs toward their latched condition.

Figure 4:
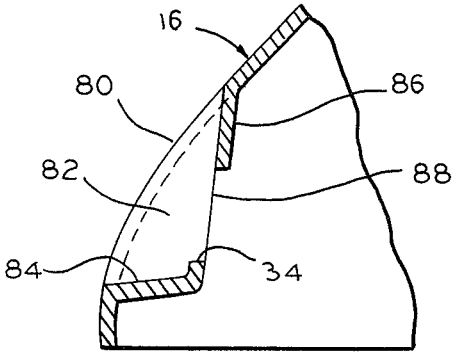
FIG. 4 is a sectional view of the upper housing portion of FIG. 1, the FIG. 4 showing being a section through lines 4—4 of FIG. 5.
Figure 5:
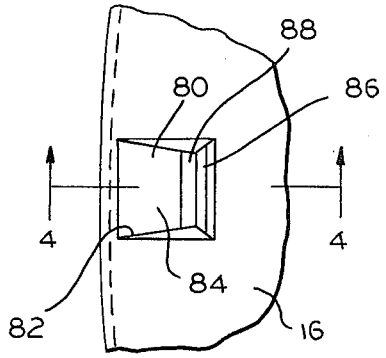
FIG. 5 is a plan view in elevation of the latch portion of the upper housing of FIG. 1.

The pawl receiver 80 in the upper housing is shown by FIGS. 4 and 5. The receiver area is cast in the upper housing during the casting or forming of the upper housing. The outer surface of the upper housing is indented in this area with a generally rectangular indent 82. The indent has a generally horizontal wall 84 (FIG. 4) terminating at a vertical wall, the vertical wall 86 being slotted at 88 to provide the receiver ledge 34 for the latch pawl hook as seen in FIG. 2. In that figure, the upper and lower housings are latched by the pawl hook 46 engaging its receiver ledge 34, the pawl being held in the latched position by the bias of the torsion springs.

To open the luminaire from its closed position, the pawl trigger 42 is grasped or engaged by the finger of the maintenance person and the pawl is manually depressed (to the left from the position shown in FIGS. 2 and 6) against the bias of the torsion springs. In this position, the pawl hook is released from its engagement with the upper housing ledge 34 and may be pivoted within the hook member bearings to free the lower housing for rotation downwardly about its hinge 20.

To remove the latch pawl for replacement, the luminaire is opened, as described. The torsion springs are released from the recess 48 to release the spring bias to the position shown in dashed form in FIG. 6 to enable detachment of the springs individually, transversely from the pivot pins. The pivot pins 44 may be freed of the hook members 70 to enable the pawl to be removed through the open mount of the lower housing.

Figure 6:
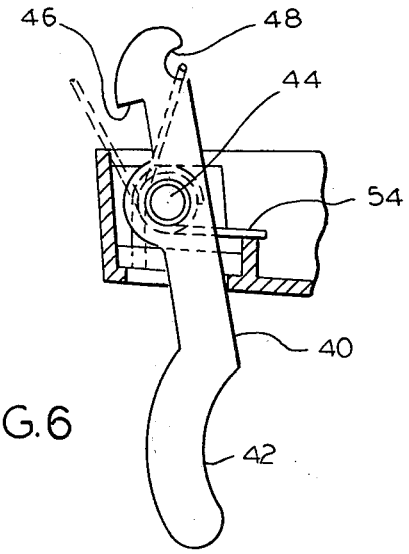
FIG. 6 is a side elevational view of the latch pawl in a section similar to FIG. 2 showing the latch released to enable the luminaire to be opened.
Figure 7:
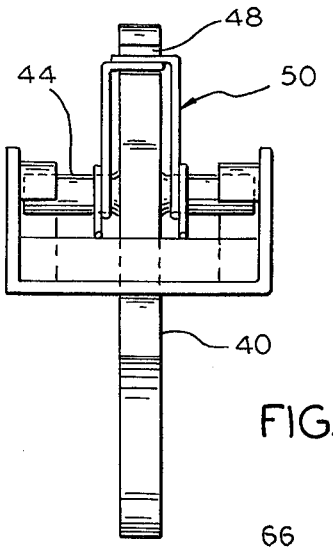
FIG. 7 is a rear view in elevation of the latch pawl of FIG. 6.

To replace the latch pawl, the reverse steps are taken. The springs are mounted on the pawl pins from respective sides (the position of FIG. 3). The pawl pins are fitted into the inverted hook members 70, and the tangs 54 of the springs are raised onto the rear wall ribs (FIG. 6). The stepped spring projections 56 are hooked into the recess 48 to bias the latch pawl and secure the pawl within the hook members 70. The pawl is thereby secured to the lower housing allowing rotation about the axis of pivot rods 44 against the bias of the torsion springs. The latch is in place for raising the lower housing into closing engagement with the upper housing as seen in FIG. 1. The latch pawl engages the upper pawl indentation ledge 34 and is held by the bias of the springs locking the two housings together.

We claim:

1. A latch mechanism for an outdoor luminaire of the type having a generally stationary upper housing affixed at one end to a mast arm, a lower housing hinged to said upper housing adjacent the one end thereof, and in which said lower housing includes refractor structure between the hinged end of the housing and the end remote from said hinged end; the latch mechanism for the remote end of said lower housing including in combination a pawl, means for mounting said pawl internally in the lower housing adjacent said remote end and pawl receiver structure in said upper housing; said pawl comprising a unitary member having a central mounting portion including laterally extending mounting arms, a head for engaging said receiver and a trigger portion extending through an opening in the lower housing for accessibility externally of the lower housing; said mounting means comprising integral pocket structure of said lower housing including a pair of spaced apart hook members affixed said lower housing to receive said arms and hold said latch member against upward movement, torsion spring means mounted on said arms with said torsion spring means having at least one tang resting on an integral rib upstanding from said lower housing to prevent downward movement of said pawl member, said torsion spring means having a projection engaging and biasing the pawl head toward the receiver in the upper housing to latch the lower housing against pivotal movement relative to the upper housing, and said receiver comprising an opening in said upper housing, said pawl member being removable from said lower housing pocket structure with said pawl head released from the upper housing by depression of the torsion spring tang and release of the pawl arms from the hook members to allow removal of the pawl and springs from the pocket structure for replacement without the need for any tools.

2. A latch mechanism as claimed in claim 1, in which said torsion spring means comprises a separate torsion spring for each mounting arm with each spring having a tang and each having a projection bearing against the pawl.

3. A latch mechanism as claimed in claim 1, in which the opening in the lower housing for the trigger portion of the pawl is lesser in lateral extent than the lateral extent of said pawl arms to prevent removal of the pawl with the lower housing closed to said upper housing, and in which the longitudinal extent of the opening provides stops to limit the movement of the pawl within the lower housing.

4. A latch mechanism as claimed in claim 1, in which said hook members are inverted J shaped members cast into the lower housing and in which the toe of the J shape is directed toward said rib to enable said pawl to be removed by clearing first the toe and rib of the lower housing.

* * * * *